US005653439A

United States Patent [19]

Rider et al.

[11] Patent Number: 5,653,439

[45] Date of Patent: Aug. 5, 1997

[54] EXIT TRAY CORRUGATION SLIP ROLLS WITH A VARIABLE FORCE IDLER

[75] Inventors: Jason P. Rider, Fairport; Brian R. Ford, Walworth; Russell C. Rackett, Webster, all of N.Y.

[73] Assignee: Xerox Corporation, Stamford, Conn.

[21] Appl. No.: 583,907

[22] Filed: Jan. 11, 1996

[51] Int. Cl.[6] ..... B65H 5/06

[52] U.S. Cl. ..... 271/274; 271/188

[58] Field of Search ..... 271/188, 209, 271/314, 273, 274

[56] References Cited

U.S. PATENT DOCUMENTS

| | | | |
|---|---|---|---|
| 4,359,217 | 11/1982 | Roller et al. | 271/188 |
| 4,678,178 | 7/1987 | Akiyama et al. | 271/273 |
| 4,789,150 | 12/1988 | Plain | 271/220 |
| 5,152,522 | 10/1992 | Yamashita | 271/188 |
| 5,153,663 | 10/1992 | Bober et al. | 271/209 |
| 5,173,596 | 12/1992 | Kapinos et al. | 271/274 |
| 5,265,864 | 11/1993 | Roux et al. | 271/188 |
| 5,280,901 | 1/1994 | Smith et al. | 271/188 |

FOREIGN PATENT DOCUMENTS

| | | | |
|---|---|---|---|
| 726580 | 5/1932 | France | 271/274 |
| 0248852 | 11/1986 | Japan | 271/188 |
| 0192661 | 8/1989 | Japan | 271/188 |
| 404072246 | 3/1992 | Japan | 271/274 |

OTHER PUBLICATIONS

Mandel et al., "Sheet Skewing Systems for Passive Decelerating Eject Rolls", Xerox Disclosure Journal; vol. 17, No. 3, May/Jun., 1992, pp. 135–137.

*Primary Examiner*—H. Grant Skaggs
*Attorney, Agent, or Firm*—T. L. Fair

[57] ABSTRACT

An apparatus and method that describes utilizing a corrugation slip nip system, including a variable force idler that encompasses three stages, to prevent buckling of copy sheets traveling at a high rate of speed upon exiting from a high speed printing machine to the exit tray for stacking. Buckling concerns are eliminated by allowing the sheet, driven by a high speed positive drive nip, to slip through the slower speed corrugation nip, yet still having enough drive force in the slip nip to drive the sheet into the exit tray. In order to vary the normal force on the sheet, a three stage variable force idler is used. The first stage oversizes the inner diameter of the idler rollers on the idler shaft. The second stage uses a slot in the spring which allows the idler shaft to move upward without deflecting the spring. These first two stages are particularly adapted for light weight paper. The third stage occurs when the idler shaft is topped out in the shaft slot such that the paper deflects the spring causing additional force to be applied to the paper to drive the paper out of the system and into the exit tray. The third stage is reached only where heavy weight paper is used because heavy weight paper has sufficient beam strength to deflect the spring.

16 Claims, 5 Drawing Sheets

EXIT TRAY CORRUGATION SLIP ROLLS WITH A VARIABLE FORCE IDLER

BACKGROUND OF THE INVENTION

This invention relates generally to exit tray corrugation in printers or copiers, and more particularly concerns a three stage variable force idler for exit tray corrugation.

As xerographic copiers and printers of all kinds increase in speed, it is increasingly important to provide copy sheet output devices that can reliably stack copy sheet output devices that can reliably stack copy sheet output from such machines. At present, some machines feed copy sheets to stacking trays at such high rates that jams are caused in the trays because preceding sheets do not have time to settle to the bottom of the stacking tray before succeeding sheets are forced into the trays by the transport systems of the machines. Stacking problems occur when the exit rolls send the copy sheet so far up the stacking ramp that the following copy sheet runs into the trail edge of the previous copy sheet before the previous copy sheet has an opportunity to settle down the stacking ramp. Also, the trail edge of preceding copy sheets are sometimes lifted up and out of the stacking tray by the lead edges of incoming sheets because of a small interdocument sheet gap.

The following disclosures may be relevant to various aspects of the present invention and may be briefly summarized as follows:

U.S. Pat. No. 5,280,901 to Smith et al. discloses a sheet feeding and corrugating system, especially for output of image substrate sheets of a reproduction apparatus, wherein the sheets are fed in a normal path through a sheet feeding nip comprising plural spaced sheet feeding rollers. Both feeding and variable corrugation of flimsy or stiff sheets is provided by spherical balls freely mounted in generally vertical ball retainers providing for vertical movement and dual axis rotation against the sheet feeding rollers to define the sheet feeding nip and by additional similar balls (in additional similar ball retainers) intermediately of the feed rollers, which additional balls are unsupported vertically except by bottom-of-travel retainers so that these additional intermediate balls roll gravity-loaded against a sheet being fed through the nip to provide sheet corrugation varying automatically with the stiffness of the sheet, and are freely liftable up to the level of the nip by stiff sheets resisting corrugation. These balls may be readily added to or removed to independently increase or decrease the sheet nip and/or corrugation forces at their respective locations transverse the nip. A sheet side shifting mechanism can laterally offset the sheets in the same nip to eject offset, by moving only the sheet feeding rollers, without resistance from the stationarily mounted balls, all of which roll freely laterally as well in the normal feeding direction.

U.S. Pat. No. 4,789,150 to Plain discloses a sheet stacking apparatus for use with throughput from high speed copiers or printers includes dual independently acting control flaps that provide positive control of sheets being stacked in the apparatus by controlling the trail edges as well as the entire sheets as they are fed into a catch tray.

Xerox Disclosure Journal entitled "Sheet Skewing Systems for Passive Decelerating Eject Rolls" by B. Mandel et al, Vol. 17, No. 3, May/June, 1992, pp. 135–137, discloses non-nip corrugation systems with common size passive decelerating eject rolls that insure proper registration in an up-hill compiling tray by skewing sheets.

SUMMARY OF INVENTION

Briefly stated, and in accordance with one aspect of the present invention, there is provided an apparatus for corrugating copy sheets travelling at high rates of the speed toward an exit tray, comprising: an idler shaft; idler rollers defining an aperture centrally located in the idler rollers for the idler shaft to be placed therethrough; a drive shaft containing drive rollers thereon with the drive shaft being adjacently positioned relative to the idler shaft such that one of the drive rollers is positioned between two of the idler rollers; and means for applying different forces on the copy sheets passing between the idler rollers and the drive rollers.

Pursuant to another aspect of the present invention, there is provided a method for corrugating copy sheets traveling at high rates of speed, in a printing machine, by sending the copy sheets, having a weight thereto, between idler rollers, located on an idler shaft, and drive rollers, located on a drive shaft, the idler shaft and the drive shaft are positioned adjacent to one another, comprising: moving each of the copy sheets between the idler rollers and the drive rollers for slowing down the speed of the copy sheets upon; varying force applied to the copy sheets according to the weight of the copy sheets; and stacking the copy sheets in an exit tray.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
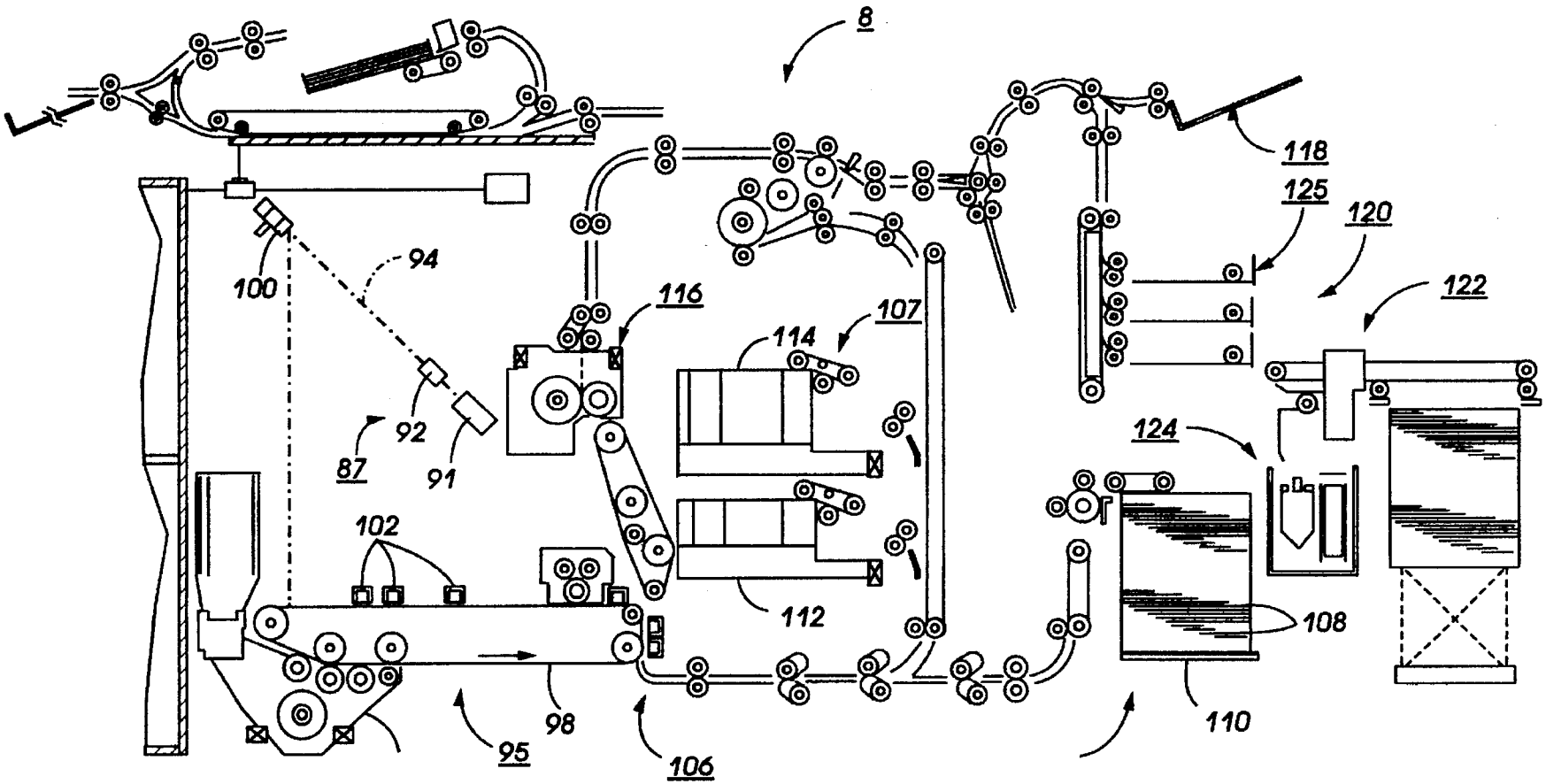
FIG. 5 is an elevational view illustrating the principal mechanical components of the printing system.

Reference is now made to the drawings where the showings are for the purpose of illustrating a preferred embodiment of the invention and not for limiting same, the various processing stations employed in the printing machine illustrated in FIG. 5 will be briefly described.

Referring now to FIG. 5, printer section 8 comprises a laser type printer and for purposes of explanation is separated into a Raster Output Scanner (ROS) section 87, Print Module Section 95, Paper Supply section 107, and Finisher 120. ROS 87 has a laser, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, or to output collating trays in finisher 120. Finisher 120 includes a stitcher 122 for stitching (stapling) the prints together to form books, a thermal binder 124 for adhesively binding the prints into books and a stacker 125. A finisher of this type is disclosed in U.S. Pat. No. 4,828,645 and 4,782,363 whose contents are hereby incorporated by reference.

Figure 1:
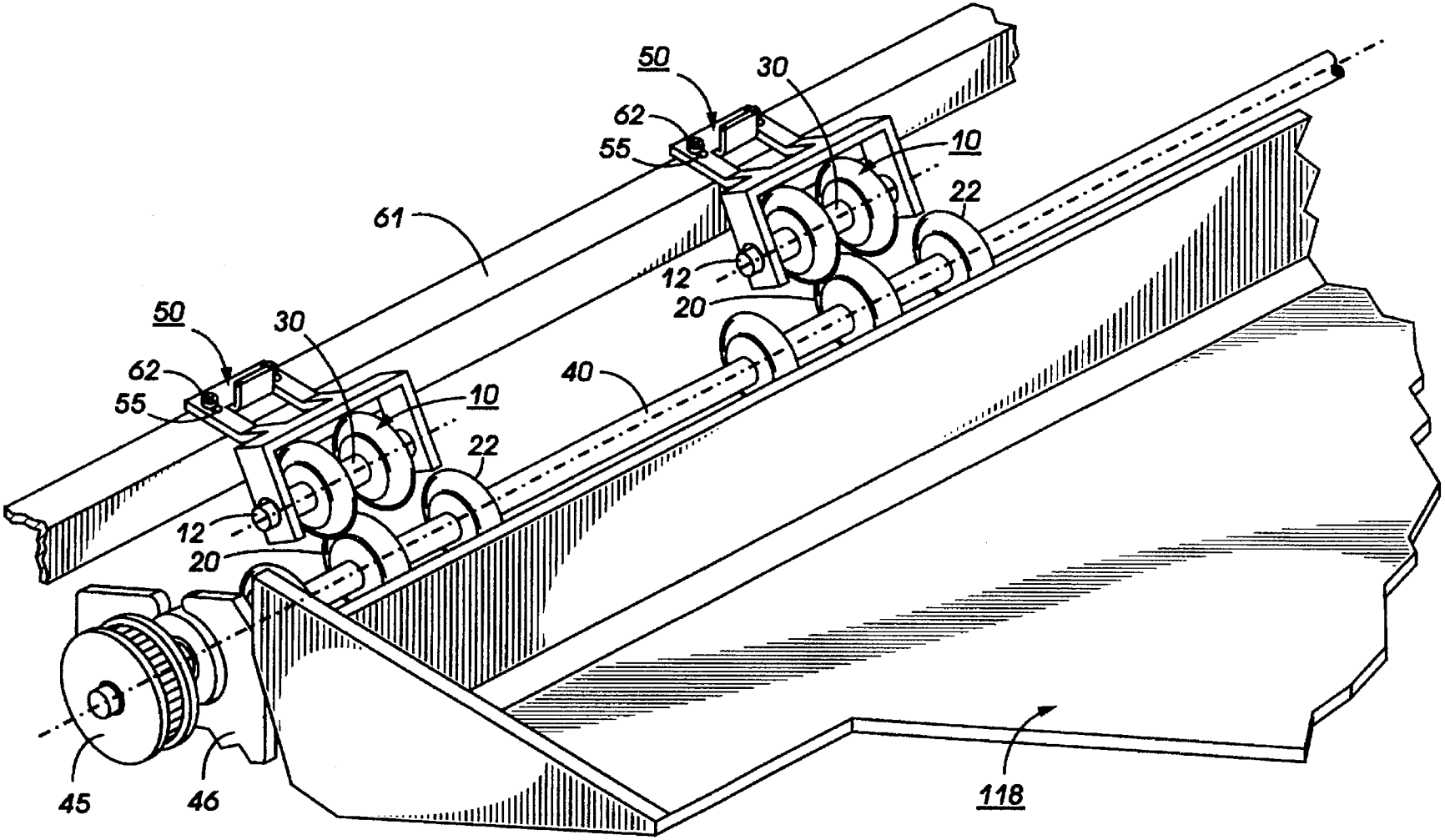
FIG. 1 is an elevational schematic of an exit tray system incorporating the present invention.

Reference is now made to FIG. 1, which shows an elevational schematic view of an exit tray system incorporating the present invention. A drive shaft 40 and idler shaft 12, 30 are positioned in adjacent proximity to one another so that a copy sheet can be corrugated between them. The drive shaft 40 contains a drive roller 20 between two corrugation rolls 22 (e.g. polyurethane material). An end plate 46 and a pulley 45 are present on either end of the drive shaft 40.

With continued reference to FIG. 1, the drive roller 20 is positioned adjacent the inner idler shaft 30 between a pair of idler rollers 10. The copy sheet passes between the idler rollers 10 and the drive rollers 20 as the copy sheet heads toward the exit tray 118. The inner idler shaft 30 between the two idler rollers 10 has an outer diameter at least 2 mm greater then the outer diameter of the end idler shaft 12. A step is formed in the idler shaft where the inner idler shaft 30 and the end idler shaft 12 meet.

Figure 2:
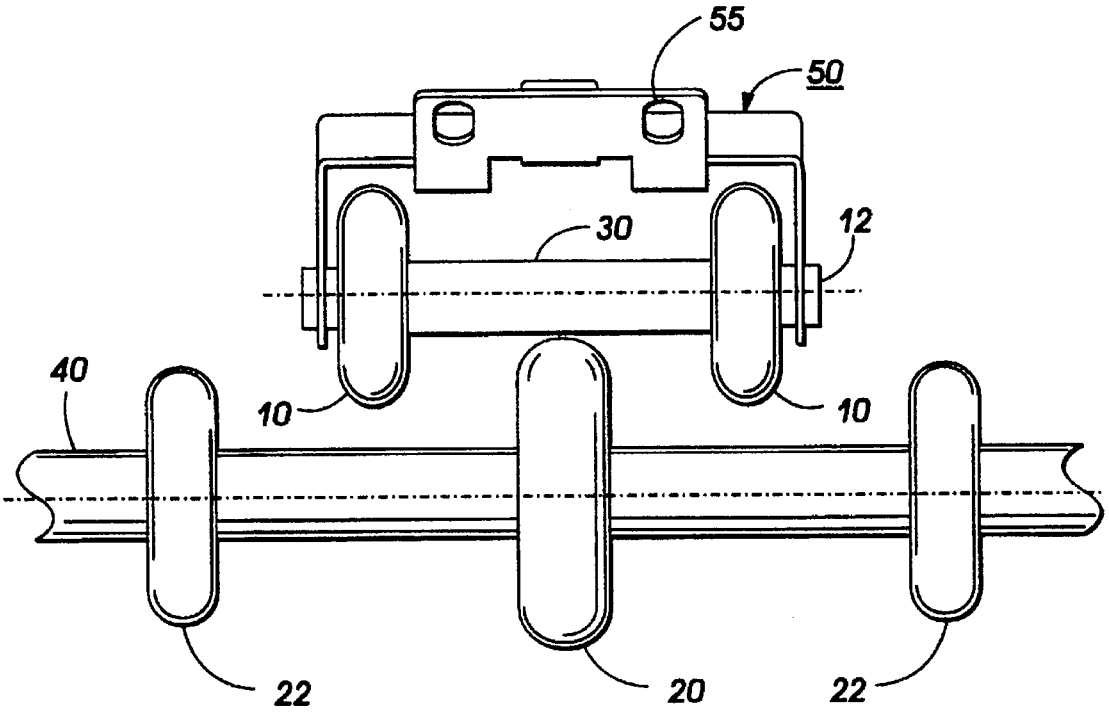
FIG. 2 is a front elevational view of the idler rolls incorporating the present invention.

Reference is now made to FIG. 2, which shows a front elevational view of the idler rollers relative to drive roller. A drive roller 20, located on a drive shaft 40, is positioned between a pair of idler rollers 10, located on an idler shaft, for corrugation of a copy sheet passing therethrough. The outer diameter, OD, of the inner idler shaft 30 is greater than the outer diameter of the end idler shaft 12 (see FIG. 1) that passes through the bored out idler roller 10. Slots 55 are present in the spring 50 for corrugation adjustments for the copy sheet passing through.

As the speeds of printing and copying machines continue to increase, the exit speeds (e.g. 1300 mm/s) of the copy sheet increase. This increase in exit speed creates stacking problems due to the sheets exiting at such a high rate of speed that the sheets cannot be contained in the output tray. Further complications arise from sheet buckling. In the present invention, the exit speed of the sheets is reduced by slowing down the last nip before exit into the tray. A corrugation drive system is used, which contains a three stage variable force idler of the present invention, to slow down (i.e. to less than 950 mm/s) the exit speed of the sheets. However, while the present invention reduces the exit speed of the copy sheet, the reduction in speed is not sufficient to use all of the Interdocument gap that would cause the copy sheets to collide with one another. Buckling of the copy sheet concerns arise when a copy sheet is driven from the faster positive nip into a reduced speed nip of the exit tray. This problem is eliminated using the present invention. In the present invention, the corrugation system enables the positive drive nips to drive the sheet through the corrugation nips, while still allowing the nips enough drive at the lower speed to move the sheet into the exit tray. Experimentation has also shown that the present invention improves stacking at existing exit speeds (e.g. about 750 mm/s).

Figure 3A:
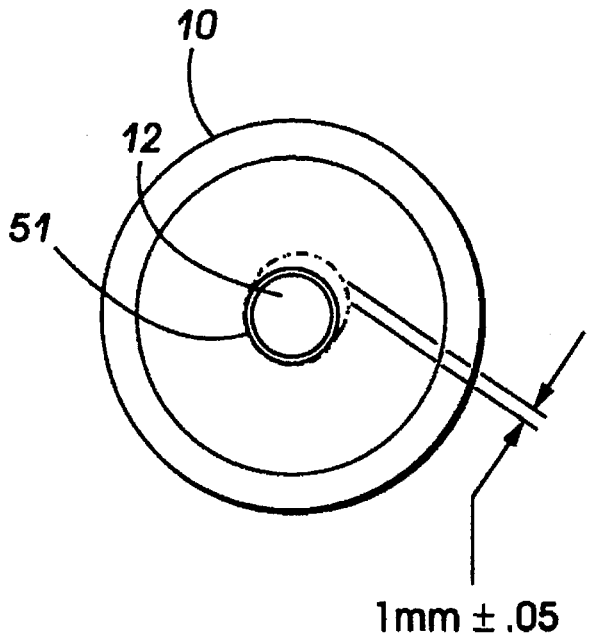
FIGS. 3A and 3B are side elevational views of the first two stages of the variable force idler of the present invention.
Figure 3B:
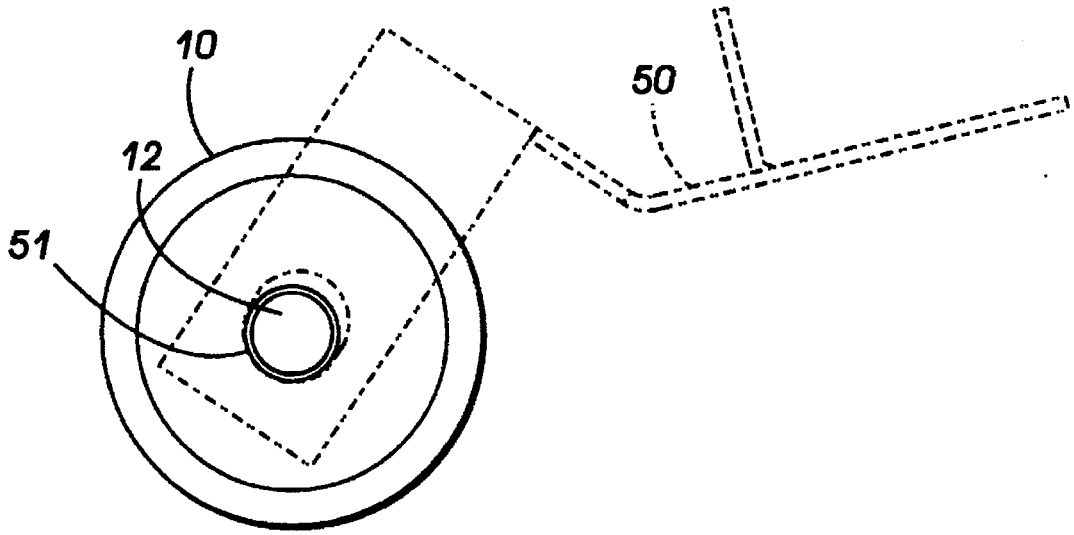
Figure 4:
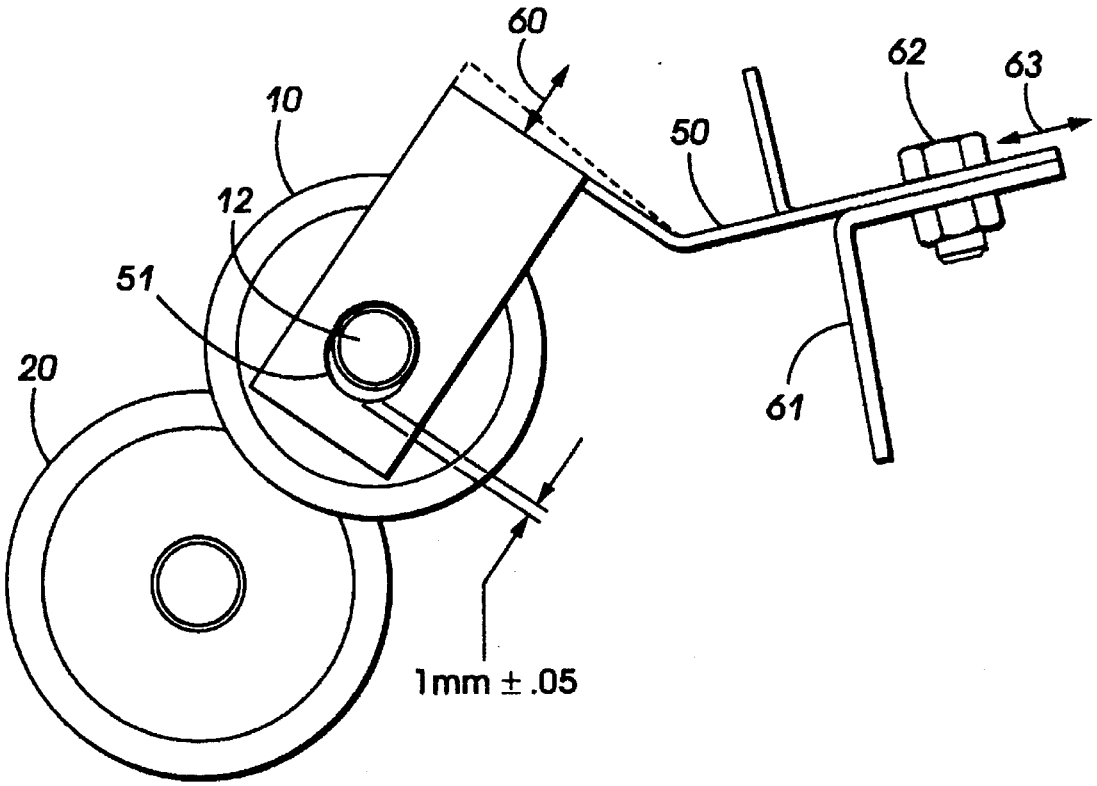
FIG. 4 is a side elevational view of the third stage of the variable force idler of the present invention.

Reference is now made to FIGS. 3A, 3B, and 4 which show the three stages of the variable force idler of the present invention. Present corrugation systems provide excessive force on light weight paper (e.g. about 16 lbs.), causing sheet damage, in order to provide the required force for driving heavyweight paper (e.g. about 110 lbs.). Thus, the present invention provides a variable force loading system to vary the drive force needed depending upon the paper weight being used. Also, due to problems involving stubbing of the lead edge of the copy sheet into the corrugation nips, the present invention has a minimal initial normal force on the copy sheet, so that the copy sheet (e.g. paper) enters the nip without having to deflect the entire weight of the idler shaft and the spring 50. The first two stages of the present invention, shown in FIGS. 3A and 3B, occur for light weight paper. The third stage, shown in FIG. 4, of the variable idler force is only required for heavy weight paper. The beam strength of the paper through the corrugation nip determines how many of the three stages are used in the present invention. Each copy sheet goes through the variable force idler which enables copy sheets of various paper weights to be used during a print run without requiring separation according to paper weight.

Referring now to FIG. 3A, stage one of the variable force idler involves an oversizing of the inner diameter hole 11, 1D, of the plastic idler rollers 10 on the end idler shaft 12 by approximately 1 mm ±0.05 mm. For example, if the ID of the idler roller is about 5 mm, then the outer diameter of the end idler shaft must be about 4 mm to provide the 1 mm of play therebetween. This 1 mm of play between the end idler shaft 12 and the inner diameter 11 of the idler roller 10 allows light weight paper (e.g. about 16 lbs.), in particular, to enter the corrugation nip without having to deflect a significant force. The only force acting upon the light weight paper at this point is the weight of the plastic (e.g. polycarbonate) idlers.

Referring now to FIG. 3B, stage two of the variable force idler involves a slot 51 in the spring 50 which allows the idler shaft which contains the idlers to be raised upward without deflecting the spring 50 (shown in phantom). This allows light weight paper, in particular, to pass through the corrugating nip system without experiencing excess force from the spring 50. In this stage, the light weight paper receives the necessary normal force required to make the corrugation system effective without causing copy sheet damage.

Reference is now made to FIG. 4, the third and final stage of the variable force idler is when the idler shaft 12, 30 has been raised to the highest point (i.e. topped out) in the slot 55 (see FIG. 2). (This normally occurs when a heavy paper weight is used.) Then, the paper, having sufficient beam strength, begins to deflect the leaf spring 50, which provides additional force to the paper or copy sheet. (The deflection of the spring 50 is shown in phantom lines and arrow 60 shows the deflection movement.) This added force is necessary to drive heavy weight paper out of the corrugating system and into the tray 118 (see FIG. 1).

With continued reference to FIG. 4, the spring 50 is mounted on a bracket 61 by a mounting screw 62 which allows for spring adjustment in the directions shown by the arrow 63 directions. The slot 51 has about a 1 mm slot tolerance about the end idler shaft 12 to allow movement of the idler shaft 30, 12 to provide the ideal force for light weight paper without experiencing the additional force of the spring used for paper of heavier weight.

The present invention, upon initiation, provides an ideal corrugation for light weight paper in stages one and two and the heavy weight paper is compensated for by the springs in the third stage. Each of the two drive rolls have one of the spring idler systems shown in FIG. 4, which can be adjusted or set-up using spring mounting features.

In recapitulation, the present invention utilizes a reduced speed corrugation drive roll system, in combination with a variable force idler that encompasses three stages, to prevent buckling of copy sheets traveling at a high rate of speed on exit from the printing machine to the exit tray for stacking. Buckling concerns are eliminated by allowing the sheet, driven by a high speed positive drive nip, to slip through the slower speed corrugation nip, yet still having enough drive force in the slip nip to drive the sheet into the exit tray. In order to vary the normal force on the sheet, a three stage variable force idler is used. The first stage oversizes the inner diameter of the idler rollers on the idler shaft. The second stage uses a slot in the spring which allows the idler shaft to move upward without deflecting the spring. The third stage occurs when the idler shaft is topped out in the shaft slot such that the paper deflects the spring causing additional force to be applied to the paper to drive the paper out of the system and into the exit tray. These first two stages are for light weight paper. The third stage is reached only where heavy weight paper is used because heavy weight paper has sufficient beam strength to deflect the spring.

It is, therefore, apparent that there has been provided in accordance with the present invention, a variable force idler for corrugating that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for corrugating copy sheets traveling at high rates of the speed toward an exit tray, comprising:

an idler shaft;

idler rollers defining an aperture centrally located in said idler rollers for said idler shaft to be placed therethrough;

a drive shaft containing drive rollers thereon, said drive shaft being adjacently positioned relative to said idler shaft such that one of said drive rollers is positioned between two of said idler rollers; and means for applying different forces on the copy sheets passing between said idler rollers and said drive rollers enabling slippage of the copy sheets between said idler rollers and said drive rollers eliminating buckling of the copy sheets in moving from the high rates of speed to a slower rate of speed in a corrugation nip en route to the exit tray.

2. An apparatus as recited in claim 1, wherein said idler shaft comprises an inner idler shaft and an end idler shaft, each having an outer diameter.

3. An apparatus as recited in claim 2, wherein said inner idler shaft has a larger outer diameter than said end idler shaft.

4. An apparatus as recited in claim 3, wherein the outer diameter of said inner idler shaft is at least approximately 2 mm greater than the outer diameter of the end idler shaft.

5. An apparatus as recited in claim 3, wherein said inner idler shaft is positioned between two of said idler rollers, said inner idler shaft having an end coupled to said end idler shaft.

6. An apparatus as recited in claim 5, wherein said end idler shaft extends from said inner idler shaft through the aperture of said idler rollers, said idler rollers having a bored out center to accommodate said end idler shaft.

7. An apparatus as recited in claim 6, wherein said inner idler shaft and said end idler shaft form a step where said inner idler shaft and said end idler shaft meet.

8. An apparatus as recited in claim 7, wherein said applying means comprises a variable force idler.

9. An apparatus for corrugating copy sheets traveling at high rates of the speed toward an exit tray, comprising:

an idler shaft including an inner idler shaft and an end idler shaft, each having an outer diameter, the outer diameter of said inner idler shaft being larger than the outer diameter of said end idler shaft;

idler rollers defining an aperture centrally located in said idler rollers for said idler shaft to be placed therethrough, said end idler shaft extends from said inner idler shaft through the aperture of said idler rollers, said idler rollers having a bored out center to accommodate said end idler shaft, said inner idler shaft being positioned between two of said idler rollers, said inner idler shaft having an end coupled to said end idler shaft, said inner idler shaft and said end idler shaft form a step where said inner idler shaft and said end idler shaft meet;

a drive shaft containing drive rollers thereon, said drive shaft being adjacently positioned relative to said idler shaft such that one of said drive rollers is positioned between two of said idler rollers; and means for applying different forces on the copy sheets passing between said idler rollers and said drive rollers, wherein said applying means comprises a variable force idler including a spring being slotted having the idler shaft contained therein.

10. An apparatus as recited in claim 9, wherein said spring applies additional force to copy sheets having sufficient beam strength to deflect said spring.

11. An apparatus as recited in claim 10, wherein said spring comprises a slot about said end idler shaft, said slot in said spring having sufficient play to enable said idler shaft to raise said idler rollers as the copy sheets enter between said idler rollers and said drive rollers.

12. An apparatus as recited in claim 11, wherein said spring being slotted enables about a 1 mm gap between the slot of said spring and the end idler shaft to form about a 1 mm+0.05 mm corrugation height in the copy sheets.

13. An apparatus as recited in claim 12, wherein said spring positions said idler rollers for corrugation of the copy sheets.

14. A method for corrugating copy sheets traveling at high rates of speed, in a printing machine, by sending the copy sheets, having a weight thereto, between idler rollers, located on an idler shaft, and drive rollers, located on a drive shaft, the idler shaft and the drive shaft are positioned adjacent to one another, comprising:

moving each of the copy sheets between the idler rollers and the drive rollers for slowing down the speed of the copy sheets upon exit from the printing machine;

varying force applied to the copy sheets according to the weight of the copy sheets; and stacking the copy sheets in an exit tray enabling slippage of the copy sheets between the idler rollers and the drive rollers eliminating buckling of the copy sheets in moving from the printing machine at the high rates of speed to a slower rate of speed in a corrugation nip en route to the exit tray.

15. A method for corrugating copy sheets traveling at high rates of speed, in a printing machine, by sending the copy sheets, having a weight thereto, between idler rollers, located on an idler shaft, and drive rollers, located on a drive shaft, the idler shaft and the drive shaft are positioned adjacent to one another, comprising:

moving each of the copy sheets between the idler rollers and the drive rollers for slowing down the speed of the copy sheets upon exit from the printing machine;

varying force applied to the copy sheets according to the weight of the copy sheets wherein the varying force step comprises: moving the idler rollers using a lead edge of one of the copy sheets entering a nip of the idler rollers and the driving rollers; urging the idler shaft away from the drive shaft as the copy sheet continues moving through the idler rollers and the driving rollers causing one end of a slot about the idler shaft to urgingly contact the idler shaft causing the idler shaft and the idler rollers thereon to move; and deflecting a spring using beam strength of the copy sheets being corrugated; and stacking the copy sheets in an exit tray.

16. A method as recited in claim 15, wherein the deflecting step comprises bending the spring due to the beam strength of the copy sheet thereby adding force applied to the copy sheet.

* * * * *